US012006585B2

(12) United States Patent
Muigg et al.

(10) Patent No.: US 12,006,585 B2
(45) Date of Patent: Jun. 11, 2024

(54) METHOD FOR DEPOSITING A CHROMIUM OR CHROMIUM ALLOY LAYER AND PLATING APPARATUS

(71) Applicant: Atotech Deutschland GmbH, Berlin (DE)

(72) Inventors: Michael Muigg, Berlin (DE); Anke Walter, Berlin (DE); Matthias Rost, Berlin (DE); Sebastian Kühne, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 17/312,968

(22) PCT Filed: Dec. 11, 2019

(86) PCT No.: PCT/EP2019/084573
§ 371 (c)(1),
(2) Date: Jun. 11, 2021

(87) PCT Pub. No.: WO2020/120537
PCT Pub. Date: Jun. 18, 2020

(65) Prior Publication Data

US 2022/0074063 A1 Mar. 10, 2022

(30) Foreign Application Priority Data

Dec. 11, 2018 (EP) ..... 18211585

(51) Int. Cl.
*C25D 3/06* (2006.01)
*C25D 17/00* (2006.01)
(Continued)

(52) U.S. Cl.
CPC ..... *C25D 3/06* (2013.01); *C25D 17/00* (2013.01); *C25D 21/14* (2013.01); *C25D 21/18* (2013.01)

(58) Field of Classification Search
CPC ..... C25D 3/06; C25D 21/16; C25D 21/14
See application file for complete search history.

(56) References Cited

U.S. PATENT DOCUMENTS 1,054,735 A * 3/1913 Wolff ..... C10M 135/14 556/149
3,082,157 A * 3/1963 Francisco ..... C25D 3/30 205/208

(Continued)

FOREIGN PATENT DOCUMENTS

CN 103628098 A * 3/2014
EP 2899299 A1 7/2015

(Continued)

OTHER PUBLICATIONS

Hoshino et al., Machine Translation, JP 2009-249707 A (Year: 2009).*

(Continued)

*Primary Examiner* — Hosung Chung
(74) *Attorney, Agent, or Firm* — Renner, Otto, Boisselle & Sklar, LLP

(57) ABSTRACT

A method for depositing a chromium or chromium alloy layer on at least one substrate, the method comprising the steps (a) providing an aqueous deposition bath with a pH in the range from 4.1 to 6.9, the bath comprising
trivalent chromium ions,
formate ions, and
optionally sulfate ions, (b) providing the at least one substrate and at least one anode, (Continued)

(c) immersing the at least one substrate in the aqueous deposition bath and applying an electrical current such that the chromium or chromium alloy layer is deposited on the substrate, the substrate being the cathode, wherein, if during or after step (c) the trivalent chromium ions have a concentration below a target concentration of trivalent chromium ions, then (d) adding dissolved trivalent chromium formate to the aqueous deposition bath such that trivalent chromium ions are present in a higher concentration than before step (d), with the proviso that solid trivalent chromium formate is dissolved in a separated partial volume taken from the aqueous deposition bath to obtain said dissolved trivalent chromium formate for step (d).

19 Claims, 1 Drawing Sheet

(51) Int. Cl.
*C25D 21/14* (2006.01)
*C25D 21/18* (2006.01)

(56) References Cited

U.S. PATENT DOCUMENTS

| | | | | | |
|---|---|---|---|---|---|
| 3,264,198 | A * | 8/1966 | Wells | C25D 21/12 | 204/211 |
| 4,054,494 | A | 10/1977 | Gyllenspetz et al. | | |
| 4,196,063 | A * | 4/1980 | Barnes | C25D 3/08 | 205/243 |
| 4,274,925 | A * | 6/1981 | Bassler | C25D 5/22 | 205/93 |
| 4,417,955 | A * | 11/1983 | Barclay | C25D 3/06 | 205/288 |
| 5,883,762 | A * | 3/1999 | Calhoun | C25D 7/00 | |
| 6,024,856 | A | 2/2000 | Haydu et al. | | |
| 7,887,930 | B2 | 2/2011 | Bishop et al. | | |
| 10,619,258 | B2 * | 4/2020 | Dal Zilio | C25D 17/002 | |
| 2004/0118676 | A1 * | 6/2004 | Mizohata | H01L 21/2885 | 205/291 |
| 2007/0227895 | A1 * | 10/2007 | Bishop | C25D 5/627 | 205/287 |
| 2009/0229986 | A1 * | 9/2009 | Omura | C25D 17/00 | 205/101 |
| 2013/0196506 | A1 * | 8/2013 | Kosub | C23F 1/18 | 438/692 |
| 2015/0252487 | A1 * | 9/2015 | Mertens | C25D 5/48 | 205/180 |
| 2018/0105946 | A1 * | 4/2018 | Shimoyama | C25D 3/28 | |

FOREIGN PATENT DOCUMENTS

| | | | | |
|---|---|---|---|---|
| GB | 1571193 | | * | 7/1980 |
| JP | 2006249518 | A | | 9/2006 |
| JP | 2009-249707 | A | | 10/2009 |
| JP | 2009249707 | A | * | 10/2009 |
| JP | 2009249707 | A | | 10/2009 |
| JP | 2016-108593 | A | | 6/2016 |
| JP | 2018178141 | A | * | 11/2018 |
| WO | 2007115030 | A1 | | 10/2007 |
| WO | 2015110627 | A1 | | 7/2015 |
| WO | 2018185144 | A1 | | 10/2018 |

OTHER PUBLICATIONS

Hou et al., Machine Translation, CN 103628098 A (Year: 2014).*
PCT/EP2019/084573 International Search Report and Written Opinion of the International Searching Authority dated Mar. 2, 2020.

* cited by examiner

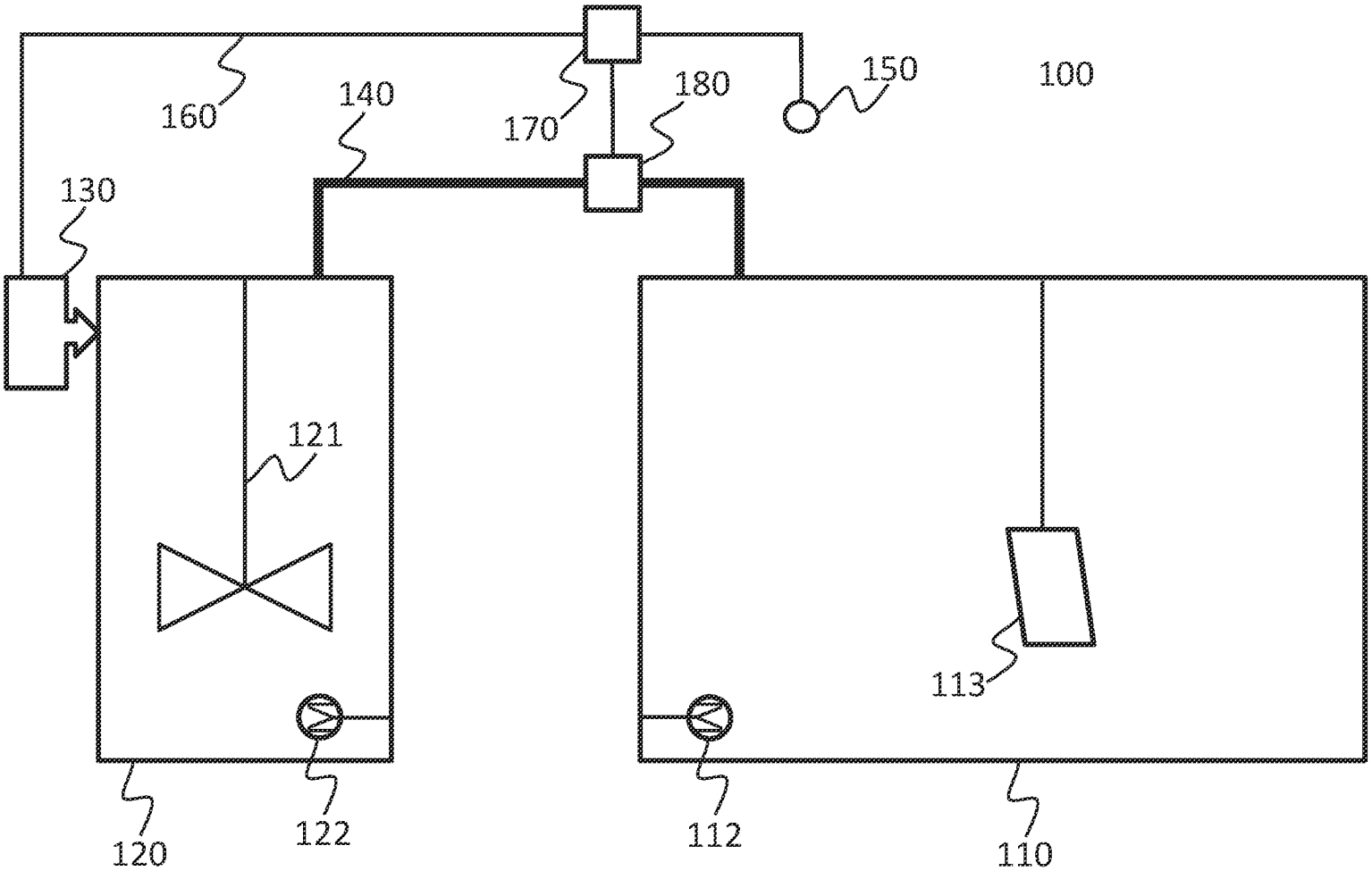
100
150
180
170
160
130
140
121
122
120
113
112
110

METHOD FOR DEPOSITING A CHROMIUM OR CHROMIUM ALLOY LAYER AND PLATING APPARATUS

The present application is a U.S. National Stage Application based on and claiming benefit and priority under 35 U.S.C. § 371 of International Application No. PCT/EP2019/084573, filed 11 Dec. 2019, which in turn claims benefit of and priority to European Application No. 18211585.7, filed 11 Dec. 2018, the entirety of both of which is hereby incorporated herein by reference.

FIELD OF THE INVENTION

The present invention relates to a method for depositing a chromium or chromium alloy layer on at least one substrate and a specifically designed plating apparatus.

BACKGROUND OF THE INVENTION

Functional chromium layers usually have a much higher average layer thickness (from at least 1 μm up to several hundreds of micro meters) compared to decorative chromium layers (typically below 1 μ) and are characterized by excellent hardness and wear resistance.

Functional chromium layers obtained from a deposition bath containing hexavalent chromium are known in the prior art and are a well-established standard.

During recent decades, chromium deposition methods relying on hexavalent chromium are more and more replaced by deposition methods relying on trivalent chromium. Such trivalent chromium-based methods are much more health- and environment friendly.

However, it has been observed that trivalent chromium-based methods typically lead to an accumulation of inorganic counter anions, such as sulfate or chloride. This occurs because consumed trivalent chromium needs to be replenished, typically by their commonly available trivalent chromium sources. A very common trivalent chromium source is chromium (III) sulfate and chromium (III) chloride.

This accumulation is a fundamental problem. Contrary to a hexavalent chromium deposition bath utilizing chromium trioxide, which cannot lead to an undesired accumulation of anions, and therefore can be operated endlessly, the life time of a trivalent chromium deposition bath is naturally limited by this accumulation. If a disturbing maximum concentration of anions (e.g. sulfate) is reached or even exceeded, often undesired precipitation is observed, blocking tubes and pumps. Furthermore, the entire deposition process is negatively affected, leading for example to an undesired roughness of a deposited chromium layer. Furthermore, the tendency of sludge forming in a respective deposition bath is drastically increased. Often, such sludge is covering the anodes, which promotes the anodic formation of undesired hexavalent chromium. It is economically very inefficient to continually regenerate such a bath and to artificially reduce the concentration of said anions. In some cases even toxic and/or dangerous degradation products are formed. For example, if trivalent chromium chloride is used for replenishment, chloride ions are accumulated even up to a concentration that toxic chlorine gas is formed. Thus, a deposition process that can be operated as long as a deposition method relying on hexavalent chromium is highly desired.

In the prior art it has been described that the accumulation of anions can be avoided by utilizing volatile anions, which are typically organic anions.

For example, WO 2015/110627 A1 refers to an electroplating bath for depositing chromium and to a method for depositing chromium on a substrate using said electroplating bath. WO'627 also discloses electrolytically consumable anions, which will not accumulate in the electrolyte. Among these anions, formate, acetate, propionates, glycolates, oxalates, carbonates, citrates, and combinations thereof are disclosed. WO'627 also suggests the use of membranes to restrict the accumulation of undesired anions over the entire electrolyte.

However, own experiments have shown that such anions often suffer the disadvantage that either their solubility is too low and, thus, they cannot practically utilized in commonly established deposition methods relying on trivalent chromium, or do not harmonize well with the complexing agents in a respective deposition bath. Typically it is preferred that the anion of the trivalent chromium source and the complexing agent in a deposition bath are identical. Very common complexing agents are weak carboxylic acids. With regards to membranes, own experiments have shown that membranes are very expensive and quickly decompose under high current densities.

U.S. Pat. No. 4,054,494 discloses a method for the maintenance of a trivalent chromium electroplating bath. However, this disclosure is not applicable to functional chromium deposits deposited at mildly acidic pH ranges.

OBJECTIVE OF THE PRESENT INVENTION

It was therefore the objective of the present invention to overcome the disadvantages mentioned above. It was in particular an objective to provide a method for depositing a chromium or chromium alloy layer, based on trivalent chromium ions, which completely prevents the accumulation of finally disturbing anions (or even entirely avoids such anions), which can be operated for much longer times without intensive regeneration, most preferably as long as a deposition bath utilizing hexavalent chromium, and which provides excellent functional chromium deposits with the demanded thickness and wear resistance. For this it was desired to not utilize membranes.

SUMMARY OF THE INVENTION

The objective is solved by a method for depositing a chromium or chromium alloy layer on at least one substrate, the method comprising the steps (a) providing an aqueous deposition bath with a pH in the range from 4.1 to 6.9, the bath comprising
  trivalent chromium ions,
  formate ions, and
  optionally sulfate ions, (b) providing the at least one substrate and at least one anode, (c) immersing the at least one substrate in the aqueous deposition bath and applying an electrical current such that the chromium or chromium alloy layer is deposited on the substrate, the substrate being the cathode, wherein, if during or after step (c) the trivalent chromium ions have a concentration below a target concentration of trivalent chromium ions, then (d) adding dissolved trivalent chromium formate to the aqueous deposition bath such that trivalent chromium ions are present in a higher concentration than before step (d), with the proviso that solid trivalent chromium formate is dissolved in a separated partial volume taken from the aqueous deposition bath to obtain said dissolved trivalent chromium formate for step (d).

Furthermore, the objective is solved by a plating apparatus for depositing a chromium or chromium alloy layer on at least one substrate, the apparatus comprising (A) a first compartment 110 for an aqueous deposition bath, comprising at least one heating unit 112, and at least one anode 113, (B) a second compartment 120 for receiving a partial volume of the aqueous deposition bath,
comprising optionally at least one stirring unit 121, and optionally at least one heating unit 122, (C) a feeding unit 130 functionally connected to the second compartment 120, (D) at least one analyzing unit 150, (E) at least one transportation means 140 connecting the first compartment 110 with the second compartment 120 to transport the partial volume of the aqueous deposition bath to the second compartment 120 and to transport a modified partial volume back from the second compartment 120 to the first compartment 110, wherein the at least one transportation means 140 comprises at least one conveyor unit 180, the at least one analyzing unit 150, the feeding unit 130, and the at least one conveyor unit 180 are connected to each other by an electrical connection 160 including a controlling unit 170, adapted such that the at least one analyzing unit 150, the feeding unit 130, the at least one conveyor unit 180, and the controlling unit 170 are suitable to communicate with each other, the feeding unit 130 is adapted to add defined amounts of a dry powder or a suspension into the second compartment 120 if the controlling unit 170 communicates a feeding signal, and the at least one conveyor unit 180 is adapted to convey the modified partial volume into the first compartment 110 if the controlling unit 170 communicates a conveying signal.

BRIEF DESCRIPTION OF THE FIGURES

In FIG. 1, the deposition apparatus is described in detail. Reference signs in FIG. 1 have the following meaning:

100 plating apparatus
110 first compartment
112 heating unit
113 anode
120 second compartment
121 stirring unit
122 heating unit
130 feeding unit
140 at least one transportation means
150 at least one analyzing unit
160 electrical connection
170 controlling unit
180 at least one conveyor unit (comprising at least a valve and a pump)

The FIGURE is a schematic drawing and does not necessarily represent sizes, arrangements, and proportions in reality.

DETAILED DESCRIPTION OF THE INVENTION

The method of the present invention allows utilizing trivalent chromium formate for replenishing trivalent chromium ions and formate ions as complexing agent for said trivalent chromium ions, although trivalent chromium formate typically has a very low and even insufficient solubility in water. Since formate anions are excellent complexing agents for trivalent chromium ions, the complexing agent can be replenished together with the trivalent chromium, i.e. in one source. This is economically optimal and allows an easy to handle process. Since formate ions are typically decomposed during the method of the present invention, no accumulation of formate ions occurs.

In the method of the present invention, the chromium or chromium alloy layer deposited in step (c) is preferably a functional chromium or functional chromium alloy layer (also often referred to as a hard chromium layer or hard chromium alloy layer) and not a decorative chromium or decorative chromium alloy layer. Thus, a method of the present invention is preferred, wherein the average layer thickness of the chromium or chromium alloy layer deposited in step (c) is 1.0 μm or more, preferably 2 μm or more, more preferably 4 μm or more, even more preferably 5 μm or more, most preferably the average layer thickness is in the range from 5 μm to 200 μm, preferably 6 μm to 150 μm. These are typical average layer thicknesses for functional chromium or chromium alloy layers. Such thicknesses are needed to provide the needed wear resistance, which is typically demanded. In some cases the lower limit preferably and specifically includes 10 μm, 15 μm or 20 μm.

In contrast, decorative chromium/chromium alloy layers typically have an average layer thickness far below 1 μm. Furthermore, substrates utilized for decorative purposes usually have a comparatively short dwell time in a respective deposition bath compared to the dwell time of substrates utilized for functional purposes. This means that in a deposition method for decorative purposes a respective deposition bath suffers a comparatively high loss of volume by means of drag out. This is drastically different for a deposition method for functional purposes. Substrates utilized for functional purposes dwell comparatively long in a respective deposition bath, i.e. no significant drag out and therefore loss of volume is experienced. This has dramatic consequences because it means that only comparatively small volumes, e.g. of water, can be replenished. Otherwise an undesired dilution of the deposition bath occurs. This means that compounds needed for replenishment cannot pre-dissolved in large volumes of fresh electrolyte or water. In the method of the present invention this fact is taken into account by utilizing solid trivalent chromium formate, which is dissolved in a separated partial volume taken from the aqueous deposition bath utilized in the method of the present invention. This allows increasing the concentration of trivalent chromium ions and formate ions to a desired target concentration and, at the same time, keeping the total volume of the aqueous deposition bath fairly constant over a long time.

Furthermore, as a result of the method of the present invention the stability of the aqueous deposition bath and the current efficiency is improved, i.e. increased.

In the context of the present invention, the term "at least one" denotes (and is exchangeable with) "one, two, three or more than three". Furthermore, the term "trivalent chromium ions" refers to $Cr^{3+}$-ions in a free or complexed form. Likewise, "hexavalent chromium" refers to chromium with the oxidation number +6 and thereto related compounds including ions containing chromium in its hexavalent state.

The method of the present invention includes steps (a) and (b), wherein the order is (a) and subsequently (b) or vice versa. Step (c) is typically carried out after both steps, (a) and (b), have been carried out.

In step (a) the aqueous deposition bath is provided. This means that the major solvent is water. Preferably, water is the only solvent. Thus, preferably the aqueous deposition bath does not comprise organic solvents.

The method of the present invention is specifically designed for an aqueous deposition bath with a pH in the range from 4.1 to 6.9. The method is not compatible with an identical deposition bath with the only exception of having a pH below 4.1 because if the pH is below 4.1 an undesired precipitation occurs. Furthermore, if the pH is below 4.1 or above 6.9 no functional chromium layer or chromium alloy layer with sufficient wear resistance and hardness is obtained.

Preferred is a method of the present invention, wherein the pH is in the range from 4.6 to 6.5, preferably in the range from 5.1 to 6.1, most preferably in the range from 5.5 to 5.9. Very good functional chromium and chromium alloy layers were obtained at a pH in the range from 5.1 to 6.1; excellent results at a pH in the range from 5.5 to 5.9. Functional chromium and chromium alloy layers obtained from an aqueous deposition bath with such a pH exhibit a good or even excellent wear resistance and hardness. The above mentioned pH ranges and values are referenced to a temperature of 20° C.

The method of the present invention is based on the finding that trivalent chromium ions can be excellently replenished if solid trivalent chromium formate is dissolved in a separated partial volume taken from the aqueous deposition. This facilitates the dissolution of the trivalent chromium formate and prevents a direct dosing of solid trivalent chromium formate into the aqueous deposition bath, which would cause undesired particles in the deposition bath. Such undesired particles can result in an undesired roughness of the deposited chromium or chromium alloy layer.

In order to enhance the solubility of trivalent chromium formate, a defined temperature in the aqueous deposition bath as well in the separated partial volume is beneficial.

Preferred is a method of the present invention, wherein the aqueous deposition bath has a temperature in the range from 20° C. to 80° C., preferably in the range from 30° C. to 70° C., more preferably in the range from 40° C. to 60° C., most preferably in the range from 45° C. to 55° C. A very preferred temperature of the aqueous deposition bath is 50° C. If the temperature significantly exceeds 80° C., an undesired vaporization occurs, which negatively affects the concentration of the bath components (even up to the danger of precipitation). Furthermore, the formation of hexavalent chromium is significantly less suppressed. If the temperature is significantly below 20° C. the deposition is insufficient. Above temperature ranges most preferably apply during step (c) of the method of the present invention.

Furthermore, preferred is a method of the present invention, wherein the temperature of the separated partial volume taken from the aqueous deposition bath is 3.1° C. to 30° C. higher compared to the temperature of the aqueous deposition bath in step (c), preferably 3.3° C. to 26° C., more preferably 3.5° C. to 21° C., even more preferably 3.7° C. to 15° C., most preferably 3.9° C. to 11° C., even most preferably 4° C. to 8° C. In this preferred case, the temperature of the separated partial volume taken from the aqueous deposition bath is always significantly higher than the temperature of the aqueous deposition bath in step (c), which positively affects the dissolution of solid trivalent chromium formate. Above temperatures include the proviso that the resulting temperature in the separated partial volume does not exceed 95° C. to avoid boiling and excessive gas evolution. If the temperature of the separated partial volume is not sufficiently higher compared to the temperature of the aqueous deposition bath, an insufficient amount of trivalent chromium formate is dissolved in the separated partial volume, leaving behind a large quantity of undissolved solid trivalent chromium formate. However, if the temperature of the separated partial volume is too high compared to the temperature of the aqueous deposition bath, an undesired evaporation of solvent occurs. Furthermore, leading back a strongly heated separated partial volume into the aqueous deposition bath will negatively affect the deposition method and undesirably disturb the temperature balance in the aqueous deposition bath.

Most preferred is a method of the present invention, wherein in step (c) the aqueous deposition bath has a temperature in the range from 45° C. to 55° C. and the temperature of the separated partial volume taken from the aqueous deposition bath is 5° C. to 15° C. higher compared to the temperature of the aqueous deposition bath.

Most preferably, the separated partial volume taken from the aqueous deposition bath has a temperature in the range from 50° C. to 65° C., preferably irrespective of the temperature of the aqueous deposition bath.

Alternatively, in some cases it is preferred that the separated partial volume taken from the aqueous deposition basically has the same temperature as the aqueous deposition bath. Thus, preferred is a method of the present invention, wherein the temperature of the separated partial volume taken from the aqueous deposition bath is within a range of ±3° C. of the temperature of the aqueous deposition bath in step (c), preferably within a range from +0° C. to +3° C., more preferably within a range from +0° C. to +2° C. In this preferred case, the temperature of the separated partial volume taken from the aqueous deposition bath is preferably either identical to the temperature of the aqueous deposition bath in step (c), or preferably only slightly different, i.e. within a small temperature variation.

In this latter (alternative) case, dissolution of trivalent chromium formate is primarily achieved by mechanical influence, preferably by stirring and/or circulation/convection.

In each case, a method of the present invention is preferred, wherein the separated partial volume taken from the aqueous deposition is agitated, preferably by stirring, most preferably by constant stirring. Most preferably, the separated partial volume is agitated, preferably by stirring, most preferably by constant stirring, and additionally the separated partial volume is heated, preferably as described above.

Due to the limited solubility of the chromium formate, dissolution of solid trivalent chromium formate in the separated partial volume requires a certain time. Preferred is a method of the present invention, wherein the solid trivalent chromium formate is dissolved within 1 minute to 120 minutes, preferably within 10 minutes to 80 minutes, most preferably within 40 minutes to 70 minutes.

Once the trivalent chromium formate is dissolved, the separated partial volume including said dissolved chromium formate should be returned to the aqueous deposition bath as soon as possible. Preferred is a method of the present invention, wherein the dissolved trivalent chromium formate is added in step (d) at latest after 8 hours after the solid trivalent chromium formate is dissolved in the separated partial volume taken from the aqueous deposition bath, preferably at latest after 4 hours, more preferably within 5 minutes to 3 hours after the solid trivalent chromium formate is dissolved in the separated partial volume taken from the aqueous deposition bath, most preferably within 6 to 60 minutes. Depending on the amount dissolved, if the dissolved trivalent chromium formate is returned after a significantly longer time than 8 hours, often an undesired sludge formation is observed in the separated partial volume, as a high concentration of trivalent chromium ions facilitates precipitation.

Preferred is a method of the present invention, wherein the trivalent chromium ions in the aqueous deposition bath have a concentration in the range from 15 g/L to 35 g/L, based on the total volume of the deposition bath, preferably in the range from 16 g/L to 30 g/L, more preferably in the range from 17 g/L to 26 g/L, even more preferably in the range from 18 g/L to 23 g/L. If the total amount is significantly below 15 g/L in many cases an insufficient deposition is observed and the deposited chromium or chromium alloy layer is usually of low quality. If the total amount is significantly above 35 g/L, the deposition bath is not any longer stable, which includes formation of disturbing precipitates.

The target concentration of trivalent chromium ions is in each case within the aforementioned concentration ranges, preferably within the range from 16 g/L to 30 g/L, more preferably within the range from 17 g/L to 26 g/L, most preferably within the range from 18 g/L to 23 g/L. If the trivalent chromium ions in the aqueous deposition bath have a concentration below this target concentration, and preferably still within one of the aforementioned concentration ranges, most preferably still within 18 g/L to 23 g/L, step (d) of the method of the present invention is carried out.

In step (d) of the method of the present invention the concentration of trivalent chromium ions in the aqueous deposition bath is increased by adding dissolved trivalent chromium formate because during step (c) the concentration of trivalent chromium ions in the deposition bath typically decreases due to metallic chromium deposition. Preferably, in the method of the present invention, after step (d), the concentration of trivalent chromium ions in the deposition bath does not exceed 35 g/L, based on the total volume of the deposition bath, preferably does not exceed 30 g/L, more preferably does not exceed 26 g/L, most preferably does not exceed 23 g/L.

Preferred is a method of the present invention, wherein in step (d) in the separated partial volume taken from the aqueous deposition bath including the dissolved solid chromium formate the trivalent chromium ions have a higher concentration than the trivalent chromium ions in the aqueous deposition bath (preferably during or after step (c)), preferably is up to 15 g/L higher, based on the total volume of the separated partial volume including the dissolved solid chromium formate, more preferably is up to 10 g/L higher, even more preferably is up to 8 g/L higher, most preferably is up to 6 g/L higher, even most preferably is up to 4 g/L higher.

Preferred is a method of the present invention, wherein in step (d) in the separated partial volume taken from the aqueous deposition bath including the dissolved solid chromium formate the trivalent chromium ions have a concentration in the range from 20 g/L to 35 g/L, based on the total volume of the separated partial volume including the dissolved solid chromium formate, preferably in the range from 20.5 g/L to 30 g/L, more preferably in the range from 21 g/L to 28 g/L, even more preferably in the range from 21.5 g/L to 25 g/L, with the proviso that in the separated partial volume including the dissolved solid chromium formate the trivalent chromium ions have a higher concentration than the trivalent chromium ions in the aqueous deposition bath (preferably during or after step (c)).

Most preferable is a method of the present invention, wherein after step (d) is carried out, the trivalent chromium ions in the aqueous deposition bath have a concentration above the respective target concentration, the target concentration preferably being within the range from 18 g/L to 23 g/L, and the concentration of trivalent chromium ions preferably is again within one of the aforementioned concentration ranges, most preferably is again within the range from 18 g/L to 23 g/L.

A preferred target concentration is within the range from 19 g/L to 21 g/L.

In the method of the present invention, step (d) is carried out at least one time. In other words, the method of the present invention comprises at least one step (d), which is carried out if during or after step (c) the trivalent chromium ions have a concentration below a target concentration of trivalent chromium ions.

The method of the present invention is preferably a continuous method. This means that A: steps (a) to (d) are continually repeated, and/or B: step (c) is one or more than one time repeated with another substrate before step (d) is carried out.

Scenario "B" preferably includes that step (c) is repeated several times with other substrates before step (d) is carried out. After step (d) is finished, the deposition bath obtained after step (d) is provided in step (a) for another sequence of steps. Thus, preferred is a method of the present invention, wherein after step (d) an aqueous deposition bath for at least one further step (a) results and steps (a) to (d) are repeated with at least one further substrate with such a deposition bath.

Although after each step (c) trivalent chromium ions are typically present in a lower concentration than prior to step (c), it is not necessarily required to add dissolved trivalent chromium formate during each or after each step (c) because not after each step (c) the trivalent chromium ions in the aqueous deposition bath have a concentration below the target concentration. The skilled person knows that the concentration must be increased if the concentration falls below the target concentration. Thus, preferred is a method of the present invention, wherein step (d) is carried out after each step (c) or is not carried out after each step (c) but after at least one step (c).

As mentioned above, in the method of the present invention, step (d) is carried out at least one time, preferably several times. This means, the method of the present invention comprises at least one step (c) immersing the at least one substrate in the aqueous deposition bath and applying an electrical current such that the chromium or chromium alloy layer is deposited on the substrate, the substrate being the cathode, wherein during or after step (c) the trivalent chromium ions have a concentration below a target concentration of trivalent chromium ions, then (d) adding dissolved trivalent chromium formate to the aqueous deposition bath such that trivalent chromium ions are present in a higher concentration than before step (d), with the proviso that solid trivalent chromium formate is dissolved in a separated partial volume taken from the aqueous deposition bath to obtain said dissolved trivalent chromium formate for step (d). Preferably, preferred features of the method of the present invention described throughout the present text apply likewise.

In some cases a method of the present invention is preferred, wherein the aqueous deposition bath does not comprise sulfate ions, preferably neither in step (a) nor after step (d). This means that neither a source of chromium ions containing sulfate is utilized nor any other compound comprising sulfate during the method of the present invention. In such a case an alternative conductivity anion is preferably utilized, more preferably chloride ions.

However, the aqueous deposition bath may contain sulfate ions, preferably as conductivity anion. Thus, in some cases a method of the present invention is preferred, wherein the aqueous deposition bath contains sulfate ions. The source of sulfate ions is preferably trivalent chromium sulfate, typically the chromium sulfate used to set up the aqueous deposition bath for the first time, in the following called "fresh aqueous deposition bath". In such a case, the concentration of sulfate ions remains comparatively constant because sulfate ions do not degrade. However, over time, the concentration of sulfate ions decreases due to drag out. Since sulfate ions are in such preferred cases an essential ingredient of the aqueous deposition bath, a constant concentration needs to be maintained, preferably by sources not being trivalent chromium sulfate. In such cases it is therefore much preferred to not add any kind of chromium sulfate to the aqueous deposition bath.

Preferred is a method of the present invention, wherein in step (a) the aqueous deposition bath contains sulfate ions and the sulfate ions have a concentration in the range from 5 g/L to 120 g/L, based on the total volume of the deposition bath, preferably in the range from 20 g/L to 100 g/L, more preferably in the range from 35 g/L to 90 g/L, even more preferably in the range from 50 g/L to 85 g/L. Most preferably, this applies to every step (a). Generally, it is most preferred to keep the concentrations of all ingredients in the aqueous deposition bath constant.

Preferred is a method of the present invention, wherein in each step (a) the sulfate ions have a concentration within a variation of ±10 g/L compared to the concentration of sulfate ions of first step (a), preferably within a variation of ±5 g/L, preferably with the proviso that the concentration of sulfate ions in each step (a) is within the range from 5 g/L to 120 g/L, based on the total volume of the deposition bath, preferably in the range from 20 g/L to 100 g/L, more preferably in the range from 35 g/L to 90 g/L, even more preferably in the range from 50 g/L to 85 g/L. First step (a) most preferably refers to a fresh aqueous deposition bath. Preferably, the method of the present invention comprises two or more than two steps (a).

A fresh aqueous deposition bath also includes formate ions as complexing agent. Since formate ions are strongly degraded during the deposition process, formate ions must be comparatively often replenished. It is therefore beneficial to replenish trivalent chromium ions together with format ions as defined in the method of the present invention. However, preferably also other sources of formate ions are utilized.

Preferred is a method of the present invention, wherein in step (a) the aqueous deposition bath comprises ammonium ions, preferably in a concentration from 30 g/L to 150 g/L, based on the total volume of the deposition bath, preferably from 70 g/L to 120 g/L, even more preferably from 80 g/L to 100 g/L.

In some cases, preferred is a method of the present invention, wherein in the aqueous deposition bath the sum of the total weight of the trivalent chromium ions and the total weight of the ammonium ions corresponds to 90 weight-% or more of the total weight of all cations in the aqueous deposition bath, preferably 95 weight-% or more, more preferably 98 weight-% or more. Thus, essentially the entire amount of cations in the deposition bath is formed by said trivalent chromium ions and said ammonium ions.

Preferred is a method of the present invention, wherein in step (a) the aqueous deposition bath comprises bromide ions, preferably in a total concentration of at least 0.06 mol/L, based on the total volume of the deposition bath, preferably at least 0.1 mol/L, more preferably at least 0.15 mol/L. Bromide ions effectively suppress the formation of anodically formed hexavalent chromium.

Preferred is a method of the present invention, wherein the trivalent chromium ions and the formate ions form a molar ratio in the range from 1:0.5 to 1:14, preferably in the range from 1:1 to 1:12, more preferably within the range from 1:4 to 1:11, even more preferably within the range from 1:5 to 1:10. Only within this molar ratio, in particular in the more preferred and even more preferred ranges, an excellent functional chromium or functional chromium alloy layer is obtained. An excellent stability is obtained if the molar ratio is in the range from 1:5 to 1:10, in particular in combination with the pH of the aqueous deposition bath, most preferably in combination with the preferred and more preferred pH ranges defined above.

Preferred is a method of the present invention, wherein the aqueous deposition bath does not comprise sulfur containing compounds with a sulfur atom having an oxidation number below +6 and boron containing compounds.

It is assumed that the absence of said sulfur containing compounds results in an amorphous chromium layer and chromium alloy layer, respectively. Thus, a method of the present invention is preferred, wherein the layer deposited in step (c) is amorphous, determined by x-ray diffraction. This applies to the chromium or chromium alloy layer obtained during step (c) of the method of the present invention and prior to any further post-deposition surface treatment that affects the atomic structure of the deposited layer, changing it from amorphous to crystalline or partly crystalline. It is furthermore assumed that such sulfur containing compounds negatively affect the hardness of the functional chromium or functional chromium alloy layer deposited in step (c).

In the context of the present invention, the term "does not comprise" a subject-matter (e.g. a compound, a material, etc.) independently denotes that said subject-matter is not present at all or is present only in (to) a very little and undisturbing amount (extent) without affecting the intended purpose of the invention. For example, such a subject-matter might be added or utilized unintentionally, e.g. as unavoidable impurity. The term "does not comprise" preferably limits said subject-matter to 0 (zero) ppm to 50 ppm, based on the total weight of the aqueous deposition bath utilized in the method of the present invention, if defined for said bath, preferably to 0 ppm to 25 ppm, more preferably to 0 ppm to 10 ppm, even more preferably to 0 ppm to 5 ppm, most preferably to 0 ppm to 1 ppm. Most preferably said subject-matter is not detectable, which includes that said subject-matter is present with zero ppm, which is most preferred.

In some cases, preferred is a method of the present invention, wherein the aqueous deposition bath does not comprise nitrogen containing compounds other than $NH_4^+$ and $NH_3$.

Preferred is a method of the present invention, wherein the aqueous deposition bath does not comprise formaldehyde, glyoxal, formaldehyde bisulfite, glyoxal bisulfite, sodium formaldehyde sulfoxylate, and mixtures thereof, preferably does not comprise aldehydes (including mono-aldehydes and di-aldehydes), sulfites (including bisulfites), sulfoxylates, and mixtures thereof, most preferably does not comprise a soluble reducing agent.

In the method of the present invention no hexavalent chromium is intentionally added to the aqueous deposition bath.

The aqueous deposition bath utilized in the method of the present invention is sensitive to a number of metal cations which are undesired and which might cause undesired discolorations. Hence, preferred is a method of the present invention, wherein in step (a) the aqueous deposition bath does not comprise copper ions, zinc ions, nickel ions, and iron ions. This preferably also includes compounds comprising said metal cations. Most preferably, none of the above mentioned metal cations are present at all.

Most preferably, in the aqueous deposition bath utilized in the method of the present invention, chromium is the only side group element according to the periodic table of elements.

Furthermore, a method of the present invention is preferred, wherein the aqueous deposition bath does not comprise glycine, aluminum ions, and tin ions.

A method of the present invention is preferred, wherein in step (a) the aqueous deposition bath comprises alkali metal cations in a total concentration in the range from 0 mol/L to 0.8 mol/L, based on the total volume of the deposition bath, preferably in the range from 0 mol/L to 0.6 mol/L, more preferably in the range from 0 mol/L to 0.4 mol/L, even more preferably in the range from 0 mol/L to 0.2 mol/L. Most preferably the aqueous deposition bath comprises alkali metal cations in a total concentration from 0 mol/L to 0.08 mol/L, even most preferably does not at all contain any alkali metal cations. According to own experiments, a low total concentration of alkali metal cations in the aqueous deposition bath as described above results in a very smooth deposited chromium or chromium alloy layer.

A method of the present invention is preferred, wherein in step (d) the solid trivalent chromium formate does not comprise alkali metal cations. This means that preferably in step (d) of the method of the present invention no alkali metal cations are added to the aqueous deposition bath, preferably independently of a total concentration of alkali metal cations in the aqueous deposition bath (i.e. alkali metal cations might be already present in the aqueous deposition bath or not).

The term "alkali metal cations in a total concentration" refers to the sum of individual amounts of metal cations of lithium, sodium, potassium, rubidium, cesium, and francium. Typically, rubidium, francium, and cesium ions are not utilized in an aqueous deposition bath. Thus, in most cases (and most preferably) alkali metal cations in a total concentration as defined above refers to metal cations of lithium, sodium and potassium, more preferably to metal cations of sodium and potassium.

In step (b) of the method of the present invention the at least one substrate and the at least one anode is provided, wherein the substrate is the cathode. Preferably, more than one substrate is utilized in the method of the present invention simultaneously.

Preferred is a method of the present invention, wherein the at least one substrate provided in step (b) is a metal or metal alloy substrate, preferably a metal or metal alloy substrate independently comprising one or more than one metal selected from the group consisting of copper, iron, nickel, and aluminum, more preferably a metal or metal alloy substrate comprising iron. Most preferably, the at least one substrate is a steel substrate, which is a metal alloy substrate comprising iron. In many technical applications a steel substrate with a smooth, wear resistant functional chromium or chromium alloy layer is needed. This can in particular be achieved by the method of the present invention.

In some cases the at least one substrate is preferably a coated substrate, more preferably a coated metal substrate. The coating is preferably a metal or metal alloy layer, preferably a nickel or nickel alloy layer, most preferably a semi-bright nickel layer. In particular preferred is a steel substrate coated with a nickel or nickel alloy layer. However, preferably other coatings are alternatively or additionally present. In many cases such a coating significantly increases corrosion resistance compared to a metal substrate without such a coating. However, in some cases the substrates are not susceptible to corrosion because of a corrosion inert environment (e.g. usage in an oil bath). In such a case a coating, preferably a nickel or nickel alloy layer, is not necessarily needed.

Therefore, preferred is a method of the present invention, wherein

- in step (c) the chromium or chromium alloy layer is directly deposited onto the at least one substrate, or
- the at least one substrate defined in step (b) additionally comprises a nickel or nickel alloy layer and in step (c) the chromium or chromium alloy layer is deposited thereon.

Preferred is a method of the present invention, wherein the at least one anode is independently selected from the group consisting of graphite anodes and mixed metal oxide anodes (MMO), preferably independently selected from the group consisting of graphite anodes and anodes of mixed metal oxide on titanium. Such anodes have shown to be sufficiently resistant in the aqueous deposition bath utilized in the method of the present invention.

Preferably, the at least one anode does not contain any lead or chromium.

In step (c) of the method of the present invention, the at least one substrate is immersed into the aqueous deposition bath, an electrical current is applied, and, as a result thereof, the chromium or chromium alloy layer is deposited on the substrate.

In step (c) of the method of the present invention either a chromium layer or a chromium alloy layer is deposited. In most cases, a method of the present invention is preferred, wherein the layer deposited in step (c) is a chromium alloy layer. Preferred alloying elements are carbon and oxygen. Carbon is typically present because of the formate ions. Preferably, the chromium alloy layer does not comprise one, more than one or all elements selected from the group consisting of sulfur, nickel, copper, aluminum, tin and iron. More preferably, the only alloying elements are carbon and/or oxygen, most preferably carbon and oxygen. Preferably, the chromium alloy layer contains 88 weight-% chromium or more, based on the total weight of the chromium alloy layer, more preferably 91 weight-% or more, even more preferably 93 weight-% or more, most preferably 96 weight-% or more.

Preferred is a method of the present invention, wherein in step (c) the electrical current is a direct current (DC), preferably a direct current having a current density in the range from 5 $A/dm^2$ to 100 $A/dm^2$, more preferably in the range from 10 $A/dm^2$ to 80 $A/dm^2$, even more preferably in the range from 15 $A/dm^2$ to 70 $A/dm^2$, most preferably in the range from 20 $A/dm^2$ to 60 $A/dm^2$.

Preferably the direct current is applied in step (c) without interruptions during step (c). Thus, the direct current is preferably not pulsed (non-pulsed DC). Furthermore, the direct current preferably does not include reverse pulses.

During step (c), the aqueous deposition bath is preferably continually agitated, preferably by stirring.

Preferred is a method of the present invention, wherein the at least one substrate obtained after step (c) comprising the deposited chromium or chromium alloy layer exhibits a Vickers Hardness of at least 700 $HV_{(0.05)}$ (determined with 50 g "load"). The wear resistance preferably is as good as the wear resistance obtained by means of hexavalent chromium based deposition methods.

In the method of the present invention it is preferred that the at least one substrate and the at least one anode are present in the aqueous deposition bath such that the trivalent chromium ions are in contact with the at least one anode. In such a preferred method a membrane or a diaphragm can entirely be avoided to separate the trivalent chromium ions from the anode (i.e. no additional compartments within the aqueous deposition bath are formed). In other words, in the method of the present invention no separation means are utilized in order to separate the trivalent chromium ions in the deposition bath from the anode. This reduces costs, maintenance effort and allows a simplified operation of the method of the present invention. Own experiments have shown that such separation means are not needed in the method of the present invention.

In step (d) trivalent chromium ions and formate ions are replenished by means of dissolved solid trivalent chromium formate. The solid trivalent chromium formate is preferably a dry powder or a suspension. Such a suspension is preferably obtained by mixing small amounts of a liquid with the dry powder such that most of the powder remains undissolved. This prevents that undesired dust is stirred up, while the solid chromium formate is provided. Most preferably also the small amount of liquid is a partial volume of the aqueous deposition bath. Alternatively, if small amounts of water must be replenished to the aqueous deposition bath (e.g. loss due to drag out), such water is preferably used to obtain said suspension.

In the method of the present invention, step (d) is initiated if during or after step (c) the trivalent chromium ions have a concentration below a target concentration of trivalent chromium ions. The concentration of trivalent chromium ions is in some cases preferably directly determined and subsequently compared to the target concentration.

However, in other cases a method of the present invention is preferred, wherein the concentration of trivalent chromium ions in the aqueous deposition bath is indirectly determined, most preferably by monitoring and/or determining the total electrical current applied to the aqueous deposition bath. Taking into account the total electrical current and current efficiency, the decrease in concentration and the concentration of trivalent chromium ions, respectively, can be calculated and compared to the target concentration.

Therefore, a method of the present invention is preferred, wherein prior to step (d) in the aqueous deposition bath an ampere-hour-meter is utilized to determine an ampere-hour value. This ampere-hour value is most preferably a trigger to initiate step (d) of the method of the present invention.

Besides adding dissolved trivalent chromium formate in step (d), a method of the present invention is preferred, wherein during the method of the present invention additionally $NH_4OH$, $NH_3$, and/or one or more than one ammonium salt is added, most preferably to adjust the pH of the aqueous deposition bath, to add sulfate ions, and/or to add additional formate ions. Thus, the one or more than one ammonium salt is preferably ammonium formate and ammonium sulfate. Preferably, no other hydroxide than $NH_4OH$ is utilized in the method of the present invention. Preferably, in the method of the present invention, $NH_4OH$, $NH_3$, and formic acid are the only compounds to adjust the pH of the aqueous deposition bath.

The present text also refers to the use of solid trivalent chromium formate in order to replenish trivalent chromium ions and formate anions in an aqueous deposition bath for depositing a chromium or chromium alloy layer on at least one substrate. Preferably in combination with the molar ratio between trivalent chromium ions and formate ions as defined above for the method of the present invention.

The present invention refers to the use of solid trivalent chromium formate in order to replenish trivalent chromium ions and formate anions in an aqueous deposition bath for depositing a chromium or chromium alloy layer on at least one substrate, wherein said aqueous deposition bath has a pH in the range from 4.1 to 6.9. Preferably in combination with the molar ratio between trivalent chromium ions and formate ions as defined above for the method of the present invention.

Thus, the present invention refers to the use of a very specific trivalent chromium salt (i.e. chromium formate) in a specific form (i.e. solid) for a very specific purpose (for replenishing an aqueous deposition bath for electrolytically depositing a chromium or chromium alloy layer). Despite the poor solubility of trivalent chromium formate, the use of solid trivalent chromium formate allows simultaneous replenishment of trivalent chromium ions and formate ions as complexing agent. This is very much preferred, economic, and prevents the accumulation of undesired anions, e.g. sulfate ions, or even avoids the presence of sulfate entirely. Furthermore, this is in particular beneficial for depositing a functional chromium or functional chromium alloy layer (for functional layers see text above). In such cases (and as mentioned above in the text) replenishment must be carefully controlled to avoid dilution of the aqueous deposition bath. Solid trivalent chromium formate is an excellent tool to overcome this problem, if the comparatively low solubility is managed. This is accomplished by the method of the present invention.

More preferred is a use of the present invention, wherein the solid trivalent chromium formate is dissolved prior to replenishing in a separated partial volume taken from the aqueous deposition bath.

Most preferred is the use of the present invention in an aqueous deposition bath utilized in the method of the present invention. Therefore, if applicable, the aforementioned features regarding the method of the present invention preferably apply likewise to the aforementioned use of the present invention.

In particular preferred is the use of the present invention, wherein the aqueous deposition bath for depositing a chromium or chromium alloy layer on at least one substrate has a pH in the range from 4.6 to 6.5, more preferably in the range from 5.1 to 6.1, most preferably in the range from 5.5 to 5.9. This is in particular preferred in combination with the molar ratio between trivalent chromium ions and formate ions as defined above for the method of the present invention.

The present invention also relates to a plating apparatus for depositing a chromium or chromium alloy layer on at least one substrate, the apparatus comprising (A) a first compartment 110 for an aqueous deposition bath,
  comprising at least one heating unit 112, and at least one anode 113,
(B) a second compartment 120 for receiving a partial volume of the aqueous deposition bath, comprising optionally at least one stirring unit 121, and optionally at least one heating unit 122, (C) a feeding unit 130 functionally connected to the second compartment 120, (D) at least one analyzing unit 150, (E) at least one transportation means 140 connecting the first compartment 110 with the second compartment 120 to transport the partial volume of the aqueous deposition bath to the second compartment 120 and to transport a modified partial volume back from the second compartment 120 to the first compartment 110, wherein the at least one transportation means 140 comprises at least one conveyor unit 180, the at least one analyzing unit 150, the feeding unit 130, and the at least one conveyor unit 180 are connected to each other by an electrical connection 160 including a controlling unit 170, adapted such that the at least one analyzing unit 150, the feeding unit 130, the at least one conveyor unit 180, and the controlling unit 170 are suitable to communicate with each other, the feeding unit 130 is adapted to add defined amounts of a dry powder or a suspension into the second compartment 120 if the controlling unit 170 communicates a feeding signal, and the at least one conveyor unit 180 is adapted to convey the modified partial volume into the first compartment 110 if the controlling unit 170 communicates a conveying signal.

Most preferably, the first compartment of the plating apparatus is a plating tank, most preferably a plating tank containing an aqueous deposition bath with a pH in the range from 4.1 to 6.9, the bath comprising trivalent chromium ions, formate ions, and optionally sulfate ions.

The aforementioned features regarding the aqueous deposition bath utilized in the method of the present invention preferably apply likewise to the aqueous deposition bath utilized in the plating apparatus of the present invention, most preferably the aforementioned features of the method of the present invention preferably apply likewise to the plating apparatus of the present invention (if applicable).

Preferably, the second compartment is a replenishing tank.

Preferably, the at least one transportation means are pipes.

Preferably, the at least one transportation means comprises a first transportation means to transport the partial volume of the aqueous deposition bath to the second compartment 120, and a second transportation means to transport the modified partial volume back from the second compartment 120 to the first compartment 110. More preferably, each transportation mans each individually comprises a conveyor unit. This ensures that in each transportation means only one flow direction is applied. In the context of the present invention, "transportation means" equally denotes (and therefore is exchangeable with) connection means suitable for conveying liquids.

Very preferably, the at least one transportation means additionally comprise at least one filter unit. Such filter units are very beneficial if the solid trivalent chromium formate is not fully dissolved or if other precipitates are formed, and therefore prevents particles from entering into the deposition bath. Alternatively or additionally, a filter unit is comprised in conveyer unit 180.

The modified partial volume is preferably the separated partial volume taken from the first compartment (preferably taken from the aqueous deposition bath) including dissolved dry powder (preferably dissolved solid chromium formate).

Furthermore, the plating apparatus of the present invention preferably comprises means for applying an electrical current in the first compartment. For details regarding the electrical current, see the text above.

In some cases a plating apparatus of the present invention is preferred, wherein the volume of the second compartment is at least 5 vol.-% of the volume of the first compartment, preferably is at least 9 vol.-%.

The volume of the second compartment is primarily determined by/based on the average electrical current throughput in ampere-hour (Ah) per hour (h) applied to the total volume of the aqueous deposition bath in the first compartment. Thus, the second compartment must have a total volume suitable to take in the needed volume of said partial volume. Preferred is a plating apparatus of the present invention, wherein the second compartment is adapted to take in a volume ranging from 15 L to 100 L of said partial volume per 1000 Ah/h electrical current applied to the aqueous deposition bath in the first compartment, preferably in the range from 25 L to 80 L. Most preferably this applies with the proviso that the temperature in said partial volume of the aqueous deposition bath is in the range from 45° C. to 65° C., most preferably in the range from 50° C. to 60° C. Under these conditions an optimal dosing can be achieved, i.e. that sufficient time can be given to dissolve solid trivalent chromium formate and to properly add the dissolved trivalent chromium formate to the aqueous deposition bath. It also allows for sufficient time for maintenance. The aforementioned applies likewise to the method of the present invention.

The method of the present invention is explained by means of the plating apparatus 100 schematically depicted in FIG. 1 by way of example.

A fresh aqueous deposition bath is set up in the first compartment 110, which is a plating tank. The fresh aqueous deposition bath comprises 18 g/L to 23 g/L trivalent chromium ions, sulfate ions, formate ions, bromide ions, and ammonium ions, and has a pH in the range from 5.5 to 5.9, referenced to 20° C. The target concentration is within a concentration from 19 g/L to 21 g/L.

The deposition bath is kept at a temperature of approximately 50° C. by using heating unit 112. A steel substrate coated with a nickel alloy layer is immersed into the deposition bath while a direct current of approximately 40 $A/dm^2$ is applied for approximately 45 minutes to electrolytically deposit a functional chromium alloy layer. The anode 113 is a graphite anode. Depositing such a chromium alloy layer is repeated for several times with additional substrates until the concentration of the trivalent chromium ions is below the target concentration. The concentration of the trivalent chromium ions is indirectly analyzed by the at last one analyzing unit 150, which is an ampere-hour-meter, analyzing the total current applied to the deposition bath. In such a case, the at last one analyzing unit 150 is positioned outside of first compartment 110. However, alternatively and if the total concentration of trivalent chromium ions is directly analyzed, the at least one analyzing unit 150 is in direct contact with the deposition bath.

In order to replenish trivalent chromium ions and formate ions, solid trivalent chromium formate as dry powder (alternatively as a suspension) is manually or automatically added to feeding unit 130. A partial volume is separated from the aqueous deposition bath in the first compartment by means of the at least one transportation means 140, which is a pipe, and transported to the second compartment, i.e. into the replenishing tank.

If the at least one analyzing unit 150, which is electrically connected by means of electrical connection 160 to controlling unit 170 and feeding unit 130, analyzes that the concentration of the trivalent chromium ions is below the target concentration, a feeding signal is generated in controlling unit 170 and communicated to feeding unit 130. Feeding unit 130 adds automatically the dry powder (or alternatively the suspension) in defined amounts to the second compartment 120. The second compartment is heated by means of heating unit 122 to a temperature of approximately 60° C. and the separated partial volume is continually stirred by stirring unit 121 for approximately 60 minutes in order to dissolve the dry powder, i.e. to obtain dissolved trivalent chromium formate. In the context of the present invention, controlling unit 170 preferably is a controlling and/or regulating unit; feeding unit 130 "functionally connected" to the second compartment equally denotes "in conjunction with" the second compartment.

Whether feeding unit 130 is adding the dry powder or the suspension, the feeding unit is adapted to add (i.e. transport, provide etc.) in each case at least solids to the second compartment. In case of a suspension, the solids are accompanied by a liquid.

After the added solid trivalent chromium formate is dissolved, a modified partial volume is obtained in the second compartment 120. Subsequently, controlling unit 170 communicates a conveying signal to the at least one conveyor unit 180 such that the at least one conveyor unit 180 conveys the modified partial volume back into the first compartment. As a result, the concentration of the trivalent chromium ions in the first compartment, i.e. in the aqueous deposition bath is increased and above the target concentration. Depositing a functional chromium alloy layer is continued with further substrates until the concentration is again below the target concentration. Being this the case, the replenishing as described above is repeated.

In the context of the present invention, the term "conveyor unit" denotes (and can be exchanged with) a "conveying unit", i.e. a unit primarily responsible to process a respective communicated signal such that the transport of the partial volume and of the modified partial volume is facilitated/carried out. Typically it is the active element in the transportation means 140.

Preferred is a method of the present invention, wherein in step (d) the dissolved trivalent chromium ions are added to the aqueous deposition bath batchwise. In other cases a method is preferred, wherein in step (d) the dissolved trivalent chromium ions are added to the aqueous deposition bath continuously or semi-continuously.

It is believed that the method of the present invention is basically applicable to similar sparingly soluble chromium salts, preferably sparingly soluble chromium salts comprising anions selected from the group consisting of acetate ions, propionate ions, glycolate ions, oxalate ions, carbonate ions, citrate ions, and combinations thereof. However, formate ions are the optimal and therefore most preferred complexing agent for trivalent chromium ions and therefore, trivalent chromium formate is the most preferred sparingly soluble chromium salt utilized in step (d) of the method of the present invention. Thus, primarily a method of the present invention is preferred, wherein in step (d) no chromium salts comprising anions selected from the group consisting of acetate ions, propionate ions, glycolate ions, oxalate ions, carbonate ions, citrate ions, and combinations thereof, are utilized, more preferably the aqueous deposition bath does not comprise at all acetate ions, propionate ions, glycolate ions, oxalate ions, carbonate ions, and citrate ions. Most preferred, formate ions are the only organic complexing agents for the trivalent chromium ions.

The invention claimed is:

1. A method for depositing a chromium or chromium alloy layer on at least one substrate, the method comprising the steps (a) providing an aqueous deposition bath with a pH in the range from 4.1 to 6.9, the bath comprising
trivalent chromium ions,
formate ions,
sulfate ions, and
ammonium ions, (b) providing the at least one substrate and at least one anode, (c) immersing the at least one substrate in the aqueous deposition bath and applying an electrical current such that the chromium or chromium alloy layer is deposited on the substrate, the substrate being a cathode, wherein, during or after step (c), when the trivalent chromium ions have a concentration that has fallen below a target concentration of trivalent chromium ions, (d) adding dissolved trivalent chromium formate to the aqueous deposition bath such that trivalent chromium ions are present in a higher concentration than before step (d), provided that solid trivalent chromium formate is dissolved in a separated partial volume taken from the aqueous deposition bath to obtain said higher concentration of trivalent chromium ions for step (d), wherein in step (a) the sulfate ions have a concentration ranging from 35 g/L to 90 g/L, based on the total volume of the deposition bath, wherein in step (a) the aqueous deposition bath comprises the ammonium ions in a concentration from 30 g/L to 150 g/L, based on the total volume of the deposition bath.

2. The method of claim 1, wherein the aqueous deposition bath has a temperature ranging from 20° C. to 80° C.

3. The method of claim 1, wherein temperature of the separated partial volume taken from the aqueous deposition bath is 3.1° C. to 30° C. higher compared to temperature of the aqueous deposition bath in step (c).

4. The method of claim 1, wherein the temperature of the separated partial volume taken from the aqueous deposition bath is within a range of ±3° C. of the temperature of the aqueous deposition bath in step (c).

5. The method of claim 1, wherein the dissolved trivalent chromium formate is added in step (d) at latest after 8 hours after the solid trivalent chromium formate is dissolved in the separated partial volume taken from the aqueous deposition bath.

6. The method of claim 1, wherein the trivalent chromium ions in the aqueous deposition bath have a concentration ranging from 15 g/L to 35 g/L, based on a total volume of the deposition bath.

7. The method of claim 1, wherein in step (d) in the separated partial volume taken from the aqueous deposition bath including the dissolved trivalent chromium formate the trivalent chromium ions have a higher concentration than the trivalent chromium ions in the aqueous deposition bath.

8. The method of claim 1, wherein in step (d) in the separated partial volume taken from the aqueous deposition bath including the dissolved trivalent chromium formate the trivalent chromium ions have a concentration ranging from 20 g/L to 35 g/L, based on total volume of the separated partial volume including the dissolved chromium formate, provided that in the separated partial volume including the dissolved chromium formate the trivalent chromium ions have a higher concentration than the trivalent chromium ions in the aqueous deposition bath.

9. The method of claim 1, wherein after step (d) an aqueous deposition bath for at least one further step (a) results and steps (a) to (d) are repeated with at least one further substrate with such a deposition bath.

10. The method of claim 1, wherein in step (a) the aqueous deposition bath contains sulfate ions and the sulfate ions have a concentration ranging from 50 g/L to 85 g/L, based on the total volume of the deposition bath.

11. The method of claim 10, wherein, when the method is repeated, in each subsequent iteration of step (a) the sulfate ions have a concentration within a variation of ±10 g/L compared to the concentration of sulfate ions of first step (a).

12. The method of claim 1, wherein in step (a) the aqueous deposition bath further comprises ammonium ions.

13. The method of claim 1, wherein prior to step (d) in the aqueous deposition bath an ampere-hour-meter is utilized to determine an ampere-hour value.

14. The method of claim 1, wherein in step (a) the aqueous deposition bath comprises the ammonium ions in a concentration from 70 g/L to 120 g/L, based on the total volume of the deposition bath.

15. The method of claim 1, wherein in step (a) the aqueous deposition bath comprises the ammonium ions in a concentration from 80 g/L to 100 g/L, based on the total volume of the deposition bath.

16. The method of claim 1, wherein in the aqueous deposition bath sum of total weight of the trivalent chromium ions and total weight of the ammonium ions corresponds to 90 weight-% or more of the of total weight of all cations in the aqueous deposition bath.

17. The method of claim 1, wherein in the aqueous deposition bath sum of total weight of the trivalent chromium ions and total weight of the ammonium ions corresponds to 95 weight-% or more of the of total weight of all cations in the aqueous deposition bath.

18. The method of claim 1, wherein in the aqueous deposition bath sum of total weight of the trivalent chromium ions and total weight of the ammonium ions corresponds to 98 weight-% or more of the of total weight of all cations in the aqueous deposition bath.

19. The method of claim 1, wherein in the aqueous deposition bath the entire amount of cations in the deposition bath is formed by the trivalent chromium ions and the ammonium ions.

* * * * *